United States Patent [19]

Johnson

[11] Patent Number: 4,846,398

[45] Date of Patent: Jul. 11, 1989

[54] ONE PIECE RECEPTACLE

[76] Inventor: Russell L. Johnson, P.O. Box 161, Weyauwega, Wis. 54983

[21] Appl. No.: 245,310

[22] Filed: Sep. 16, 1988

[51] Int. Cl.[4] ..... B65D 5/24

[52] U.S. Cl. ..... 229/143; 229/151; 229/160.2; 229/171; 229/179; 229/186

[58] Field of Search ..... 229/143, 151, 171, 179, 229/186, 160.2

[56] References Cited

U.S. PATENT DOCUMENTS

| | | | |
|---|---|---|---|
| 640,557 | 1/1900 | Haas | 229/179 |
| 998,746 | 7/1911 | Carlson | 229/179 |
| 1,141,343 | 6/1915 | Jones | 229/179 |
| 1,189,452 | 7/1916 | Ives et al. | 229/179 |
| 2,754,046 | 7/1956 | Roberts | 229/186 |
| 3,246,829 | 4/1966 | Sexton | 229/179 |
| 3,567,106 | 3/1971 | Anderson | 229/171 |
| 3,606,078 | 9/1971 | Phillips, Jr. | 229/171 |
| 4,148,429 | 4/1979 | Burr et al. | 229/143 |
| 4,648,549 | 3/1987 | Trutna | 229/143 |
| 4,809,908 | 3/1989 | Keefe et al. | 229/160.2 |

FOREIGN PATENT DOCUMENTS

| | | | |
|---|---|---|---|
| 107926 | 10/1967 | Denmark | 229/171 |
| 2453083 | 10/1980 | France | 229/171 |

*Primary Examiner*—Gary Elkins

*Attorney, Agent, or Firm*—Russell L. Johnson

[57] ABSTRACT

The invention in its simplest form is a one piece receptacle formed from a blank that is a flat sheet and where gusseted corners are individually folded and latched to form the receptacle. The latches at each end of the receptacle are joinable to add strength to the receptacle and to provide convenient carrying and/or pull handles. The receptacle may be provided with an integral cover which is secureable to the latches and strengthens and adds to the utility of the latches.

7 Claims, 4 Drawing Sheets

FIGURE 2
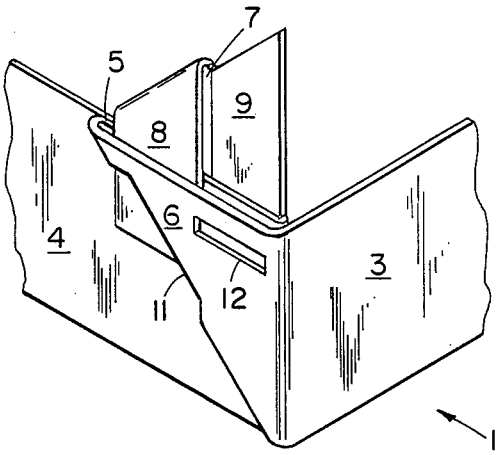
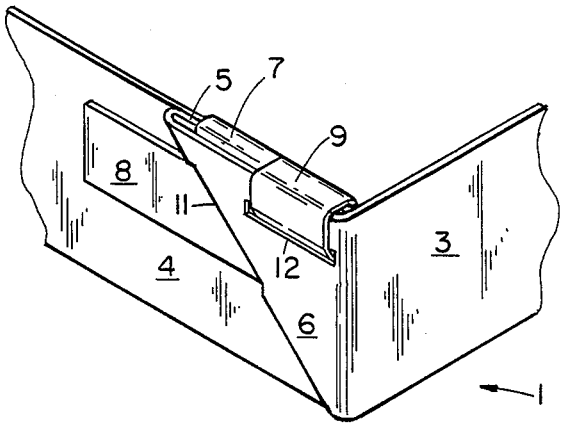
FIGURE 3
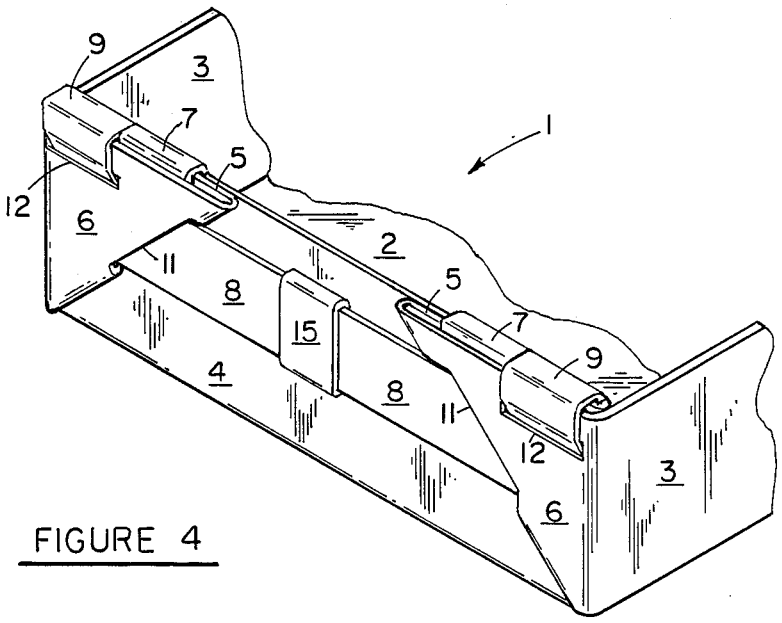
FIGURE 4

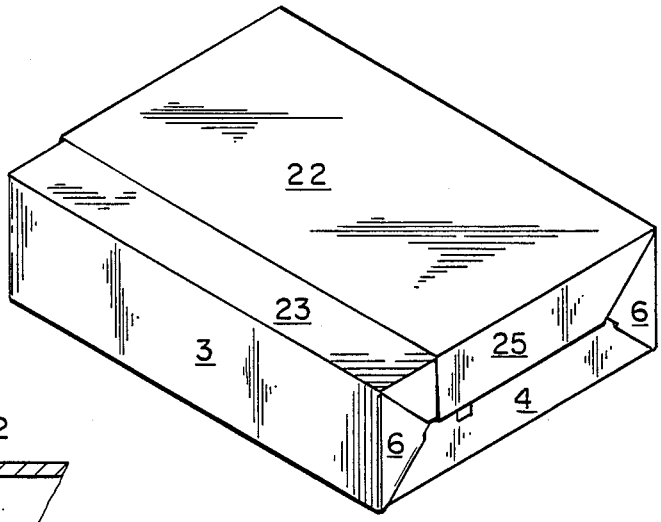
FIGURE 7
FIGURE 6
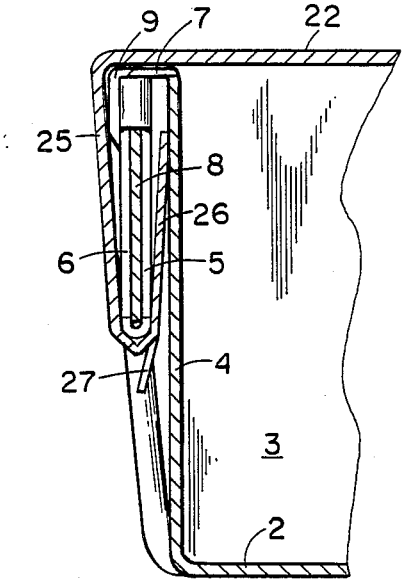
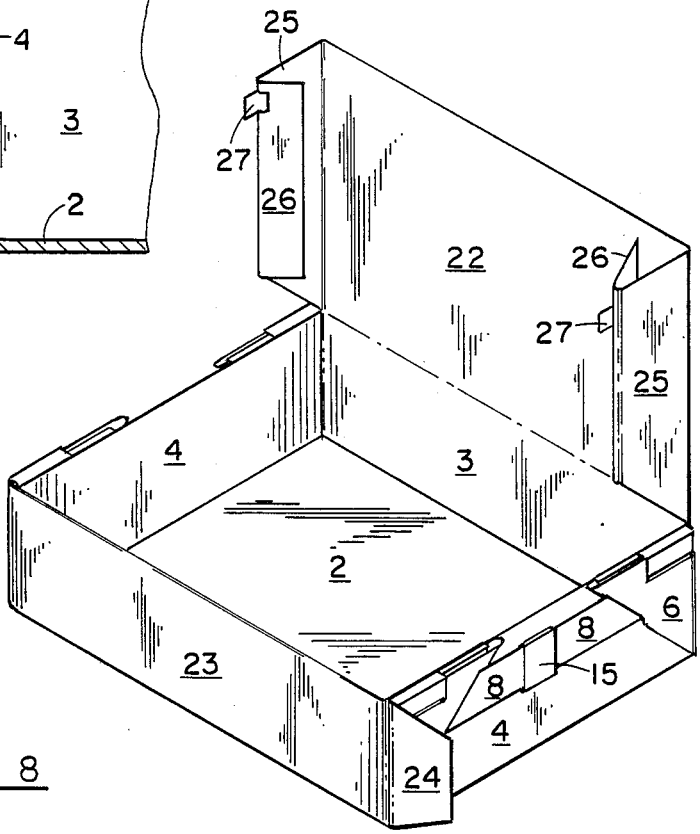
FIGURE 8

ONE PIECE RECEPTACLE

FIELD OF THE INVENTION

This invention relates to a seamless receptacle formed from a flat sheet.

More particularly, this invention relates to seamless receptacles of the type described above wherein the receptacle is in the form of a rectangular box having corner gussets.

BACKGROUND OF THE INVENTION

Rectangular seamless receptacles having corner gussets have long been known in the printing trade where they are used for the mixing and dispensing of inks. More recently, seamless receptacles have been provided to the adhesive trade by the Menasha Corp. of Menasha WI under the name of Quick Release System (QRS) (TM).

These seamless receptacles are generally single use articles and are intended to be returned to the flat configuration to facilitate the scrapping off of the residue of the contents of the receptacle.

These prior art receptacles are characterized by an awkwardness of assembly and an ease of disassembly. The assembled receptacles have limited corner strength and will permit only limited stacking of the receptacles.

OBJECTS

It is therefore, an object of this invention to provide a one piece receptacle having corner gussets wherein the receptacle is easily assembled and the corner gussets are securely latched in place so as to give strength to the corners of the receptacle and permit the stacking of a multiplicity of similar receptacles.

It is further an object of this invention to provide a receptacle as described above wherein the receptacle is provided with an integral covering means wherein the covering means is secureable in the closed configuration to the gussets and the gusset latching means.

It is further an object of this invention to provide the receptacle as described above wherein the receptacle is provided with aids to assembly and use.

Other objects will become apparent from the following specifications, claims and drawings.

PRIOR ART

U.S. Pat. No. 4,148,429 to Burr et al. teaches a receptacle of the type contemplated by this invention.

The prior art in general does not teach or suggest the latching securement of the individual gussets to the upright panels of the receptacle.

More specifically, the prior art does not teach or suggest the latching and locking means for corner gussets disclosed hereinafter.

BRIEF DESCRIPTION

The invention in its simplest form is characterized by being a seamless receptacle formed from one piece of flat material which is foldable to form a substantially rectangular receptacle having corner gussets which are individually secured to the end panels of the receptacle by securement tabs which are foldably joined to the end panels. The receptacle is further provided with integral covering panels having closure securements that act in cooperation with the gusset securement means to provide a releasable top closure securement that is sufficiently sturdy to serve as carrying handles or pull means.

BRIEF DESCRIPTION OF THE DRAWINGS

FIG. 2 is a fragmentary pictorial view of a partially assembled gusseted corner of this invention.

FIG. 3 is a fragmentary pictorial view showing the completed assembly of the corner of FIG. 2.

FIG. 4 is a fragmentary pictorial view showing gusseted corners secured to each other by means of joined latching tabs.

FIG. 6 is a pictorial view showing the blank of figure 5 in the assembled configuration.

FIG. 7 is a fragmentary elevational view of the closure of the receptacle of FIG. 5.

FIG. 8 is a pictorial view showing the assembled receptacle of FIG. 5 in the opened configuration.

DETAILED DESCRIPTION OF THE INVENTION

Figure 1:
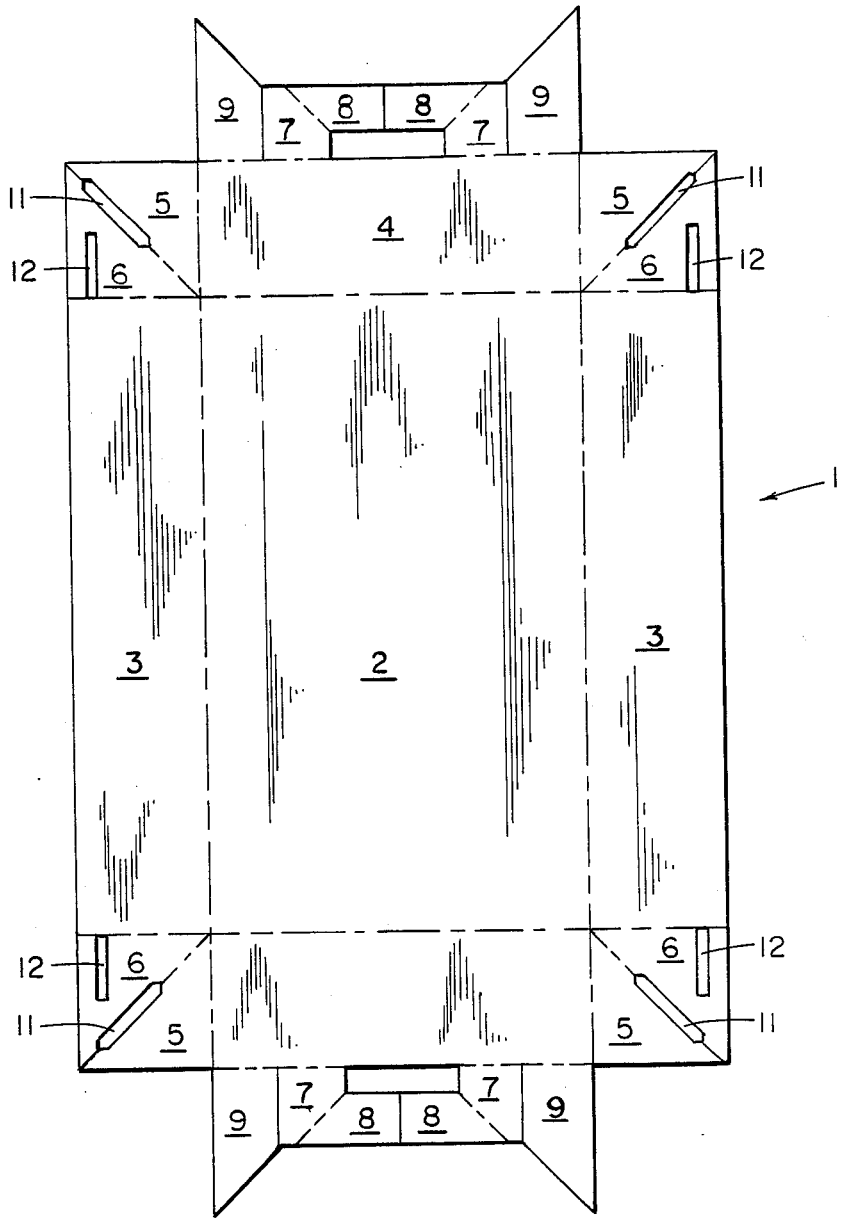
FIG. 1 is a plan view of a blank for forming a receptacle made according to this invention.

In the figures like numbers refer to like objects and the thickness of materials have been exaggerated to clarify relationships in the drawings.

Receptacle 1 is formed from a single flat sheet having adjacent panels and tabs foldably joined to each other at fold lines, shown as long-short dashed lines.

Rectangular bottom panel 2 is foldably joined to side panels 3 and end panels 4. Gusset panels 5 and 6 span the space between side panels 3 and end panels 4 at the corners of bottom panel 2. Inside gusset panels 5 are foldably joined to end panels 4 and outside gusset panels 6 are foldably joined to side panels 3. Gusset panels 5 and 6 are foldably joined to each other along lines extending diagonally from the corners of bottom panel 2 and substantially bisecting the space between side panels 3 and end panels 4. Latch slots 11 are provided along the fold line between inside gusset panel 5 and outside gusset panel 6. Lock slots 12 are provided in outside gusset panel 6, as shown in FIG. 1.

End panels 4 have foldably secured thereto locking tabs 9 and vertical latch tabs 7. Vertical latch tabs 7 have foldably secured thereto horizontal latch tabs 8. The fold lines between vertical latch tabs 7 and horizontal latch tabs 8 are diagonals such that horizontal latch tabs 8 will, in the folded position, lie along vertical latch tabs 7 to facilitate the insertion of latch tabs 8 into latch slots 11.

In FIGS. 2 and 3 the assembly of the corner gussets of receptacle 1 is illustrated.

Inside gusset panel 5 is brought into opposition with outside gusset panel 6 and thereafter, the opposed panels are folded over end panel 4. Horizontal latch tab 8 is folded into opposition with vertical latch tab 7 and the free end of horizontal latch tab 8 is inserted between gusset panels 5 and 6 and into latch slot 11 to achieve the configuration shown in FIG. 2.

Thereafter horizontal latch tab 8 is drawn through latch slot 11 drawing with it vertical latch tab 7 until latch tabs 7 and 8 are again coplanar as shown in FIG. 3. Locking tab 9 is then inserted into lock slot 12, as shown in FIG. 3, to complete the assembly of a gusseted corner of receptacle 1.

The gusseted corners of prior art one piece seamless receptacles presented a number of deficiencies that are cured by this invention.

First, the prior art gusseted corners are secured in place in pairs adjacent tot he end panels of the receptacles. The procedure for folding and securing the pairs of gusseted corners is generally awkward and difficult to achieve. The gusseted corner latching means of this invention permits the easy folding and latching in place of one gusseted corner at a time.

Second, the prior art gusseted corners exhibit retained resilience in the folds of the gusseted corners which urges the ends of the receptacle outward and often results in unwanted disengagement of the closures and disassembly of the receptacle. The latching and locking tabs of this invention serve to restrain and limit the bowing pressures that the folds can exert while providing superior structural strength and integrity to the corners.

In FIG. 4, the free ends of the horizontal latch tabs 8 are shown to be joined by means of tape 15. The joining of tabs 8 serves to further strengthen the gusseted corners and to further restrict the degree of bowing of the end panels of receptacle 1. Joined horizontal tabs 8 can serve as convenient carrying handles or pulls for sliding receptacle 1 on a flat surface as, for instance, when removing receptacle 1 from a shelf.

It is known in the art to provide integral covers for one piece seamless receptacles having gusseted corners.

The latching and locking means of this invention provides a structure for securing an integral cover in the closed position.

Figure 5:
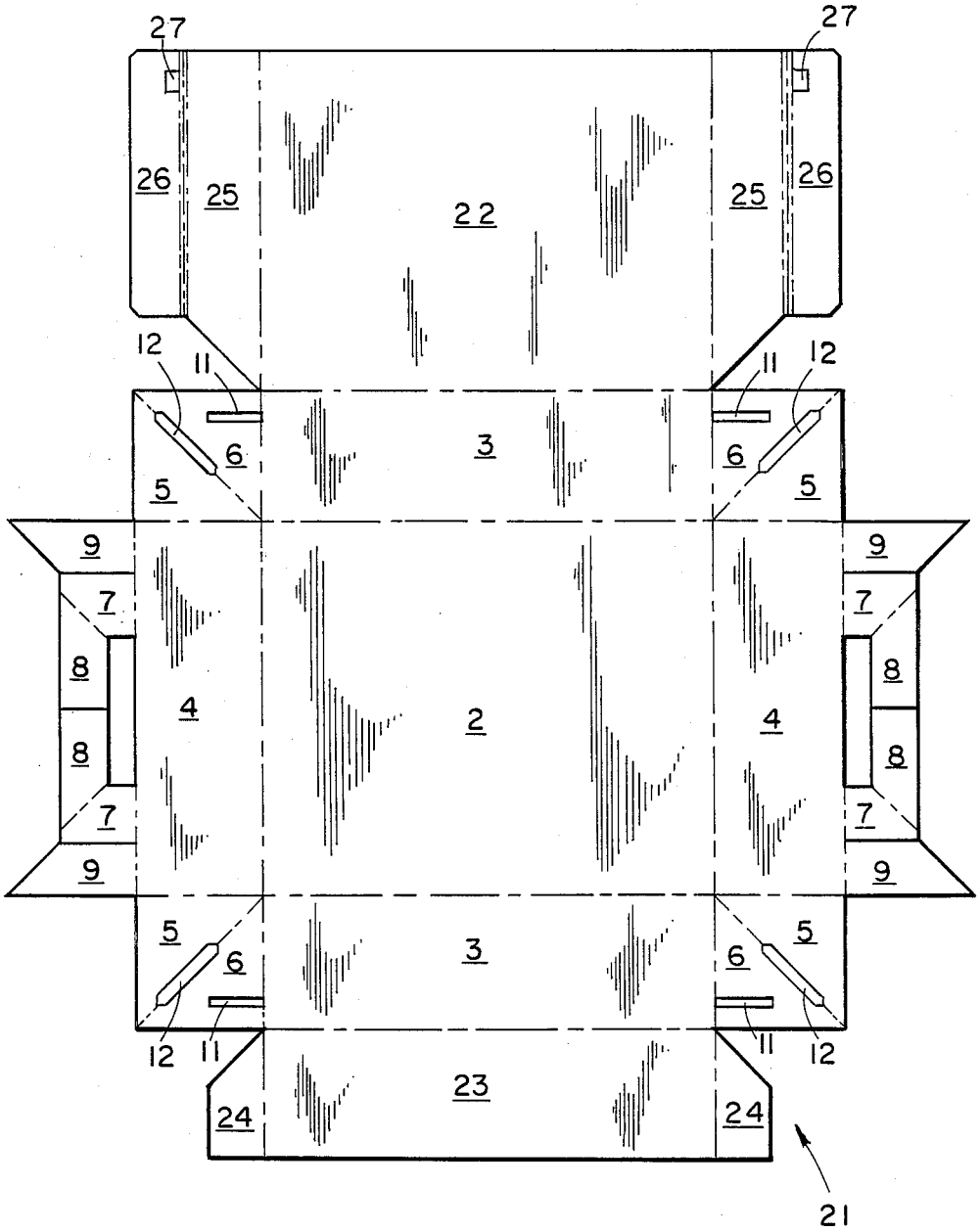
FIG. 5 is a plan view of a blank for forming another embodiment of the receptacle of this invention.

Receptacle 21 of FIG. 5 is similar to receptacle 1 of FIG. 1. Long top panel 22 is foldably secured to one side panel 3 of receptacle 21 and short top panel 23 is foldably secured to the opposite side panel 3. The combined lengths of the top panels 22 and 23 are such that long top panel 22 overlaps short top panel 23 when the tops are in the closed position as shown in FIG. 6.

As shown in FIG. 5, outside closure tabs 25 are foldably joined with long top panel 22 and inside closure tabs 26 are foldably joined to outside closure tabs 25.

The length and location of the fold lines between outside closure tabs 25 and inside closure tabs 26 is such that when receptacle 21 is assembled and top panel 22 is in the closed position, the fold lines will lie along and be coextensive with joined horizontal latching tabs 8 as shown in FIGS. 6 and 7.

Inside closure tabs 26 and outside closure tabs 25 reenforce latching tabs 8 to provide receptacle 21 with conveniently located, sturdy, and reliable carrying and/or pull handles.

The length of short top panel 23 is substantially the same as the height of side panel 3. As shown in FIG. 8, when receptacle 21 is resting on a flat surface, with short top panel 23 opposed to side panel 3 and with closure tabs 24 folded back over the ends of receptacle 21, short top panel 23 is prevented from moving up to obstruct access to the inside of receptacle 21, due to closure tabs 24 engaging the flat surface. That is, closure tabs 24 engage the flat surface and restrict the movement of short top panel 23.

When receptacle 21 is in the closed configuration it may be sometimes difficult to disengage inside closure tab 26. This invention provides inside closure tabs 26 with opening tabs 27, as illustrated in FIGS. 5 and7, to provide a pull for disengaging inside closure tabs 26.

The inventor has provided an enabling disclosure which teaches the best mode of practicing the invention known to the inventor. However, the scope of this invention should not be limited to the embodiments disclosed herein, but should only be limited by the appended claims and all equivalents thereto which would become apparent to one skilled in the art.

I claim:

1. An improved one piece seamless receptacle with gusseted corners and formed from a planar sheet of material and comprising;

(a) a substantially rectangular bottom panel, having a first pair of parallel edges and a second pair of parallel edges intersecting the first pair of parallel edges to form right angled corners, (b) side panels foldably joined to the first pair of parallel edges of the bottom panel, (c) end panels foldably joined to the second pair of parallel edges of the bottom panel, (d) inside and outside gusset panels located at the corners of the bottom panel and foldably joined to the side panels and the end panels and the inside gusset panels are foldably joined to the end panels and the outside gusset panels are foldably joined to the side panels and the gusset panels are joined to each other along diagonal fold lines that extend from the corners of the bottom panel, (e) latching slots lying along the midlength of the fold lines between the inside gusset panels and the outside gusset panels, (f) a pair of vertical latching tabs foldably joined to an outside edge of each of the end panels and spaced apart from each other at equal distances from the centers of each of the outside edges of the end panels, and (g) horizontal latching tabs projecting laterally from each vertical latching tab and directed towards an opposite latching tab joined to a vertical latching tab joined to the same end panel, and the vertical latching tabs and the horizontal latching tabs are foldably joined along diagonal lines that permit the folding of the horizontal latching tabs into parallel opposition with the vertical latching tabs.

2. The receptacle of claim 1 wherein the gusseted corners are individually assembleable by the steps of;

(a) folding the gusseted corner outwardly until the outside gusset panel is opposed to the inside gusset panel, and the fold line between the inside gusset panel and the end panel is opposed to the fold line between the outside gusset panel and the side panel, (b) folding the opposed gusset panels against the end panel, (c) folding the horizontal latching tab into parallel opposition with the vertical latching tab.

(d) inserting the horizontal latching tab between the inside gusset panel and the outside gusset panel and through the latching slot, and (e) drawing the horizontal latching tab through the latching slot until the vertical latching tab is between the inside gusset panel and the outside gusset panel and the vertical latching tab and the horizontal latching tab are coplanar.

3. The receptacle of claim 2 wherein, when the receptacle is fully assembled, the horizontal latching tabs abut each other and are joined together by tape.

4. The receptacle of claim 2 wherein the outside gusset panel defines a locking slot which projects laterally from the fold line between the side panel and the outside gusset panel and the latching slot is positioned near the outer edge of the outside gusset panel and a locking tab projects upward from the outer edge of the end panel and is parallel to and adjacent to the vertical latching tab and is foldably joined to the end panel from the vertical latching tab to the fold line between the inner gusset panel and the end panel, and wherein the locking tab, is insertable into the locking slot and, at assembly, abuts the vertical latching tab.

5. The receptacle of claim 2 wherein the receptacle is provided with a cover means having a rectangular long top panel foldably joined to one of the side panels and a rectangular short top panel foldably joined to the other side panel and the short panel has a length substantially equal to the height of the side panels and the short top panel has closure panels foldably attached thereto and projecting laterally therefrom.

6. The receptacle of claim 5 wherein the long top panel overlaps the short top panel when the top panels are in the closed position and the long top panel has foldably joined thereto, outside closure tabs which are foldably joined to inside closure tabs such that the inside closure tabs are coextensive with the horizontal latching tabs and the inside closure tabs are insertable between the horizontal latching tabs and the end panels of the receptacle.

7. The receptacle of claim 6 wherein the inside and outside closure tabs are provided with a small opening tab that extends outwardly from the fold line between the outside closure tab and the inside closure tab.

* * * * *